US010955215B2

(12) United States Patent
Witzigreuter et al.

(10) Patent No.: US 10,955,215 B2
(45) Date of Patent: Mar. 23, 2021

(54) PROJECTILE LAUNCHING APPARATUS

(71) Applicant: Tricord Solutions, Inc., Franklin, TN (US)

(72) Inventors: John Witzigreuter, Canton, GA (US); Christopher Pedicini, Franklin, TN (US)

(73) Assignee: Tricord Solutions, Inc., Franklin, TN (US)

( * ) Notice: Subject to any disclaimer, the term of this patent is extended or adjusted under 35 U.S.C. 154(b) by 0 days.

(21) Appl. No.: 16/894,686

(22) Filed: Jun. 5, 2020

(65) Prior Publication Data

US 2021/0055074 A1 Feb. 25, 2021

Related U.S. Application Data

(60) Provisional application No. 62/890,465, filed on Aug. 22, 2019.

(51) Int. Cl.
*F41B 11/646* (2013.01)
*F41B 11/643* (2013.01)
*F41B 11/73* (2013.01)

(52) U.S. Cl.
CPC ..... *F41B 11/646* (2013.01); *F41B 11/643* (2013.01); *F41B 11/73* (2013.01)

(58) Field of Classification Search
CPC ..... F41B 11/60; F41B 11/64; F41B 11/642; F41B 11/643; F41B 11/646
USPC ..... 124/71–77
See application file for complete search history.

(56) References Cited

U.S. PATENT DOCUMENTS

| | | | | |
|---|---|---|---|---|
| 6,564,788 | B1 * | 5/2003 | Hu | F41B 7/003 124/66 |
| 6,807,959 | B1 * | 10/2004 | Murdock | A63B 69/40 124/61 |
| 7,607,424 | B2 | 10/2009 | Monks | |
| 7,730,881 | B1 * | 6/2010 | Pedicini | F04B 35/04 124/65 |
| 8,820,212 | B2 | 9/2014 | Rostocil | |
| 10,330,430 | B2 * | 6/2019 | Kang | F41B 11/73 |
| 2005/0000505 | A1 * | 1/2005 | Pedicini | F04B 9/02 124/63 |
| 2005/0183709 | A1 * | 8/2005 | Marsac | F41B 11/57 124/63 |

(Continued)

FOREIGN PATENT DOCUMENTS

WO WO-2006012540 A2 * 2/2006 ..... F41B 11/57

*Primary Examiner* — Jonathan C Weber
(74) *Attorney, Agent, or Firm* — Jay Schloff; Aidenbaum Schloff and Bloom PLLC

(57) ABSTRACT

A projectile launching apparatus for launching a projectile, such as a pellet, a BB bullet, an arrow, a dart and a paintball includes a linear motion converter driven by a motor, a piston coupled to the linear motion converter and reciprocally movable within a cylinder, a gas spring and a breech assembly. The piston compresses a gas within the cylinder, after which the compressed gas expands in the barrel of the breech assembly for launching the projectile. Breech assembly includes a breech, a bolt, and bolt barrel cam, which rotate with the gas spring to allow a projectile to enter the breech and then to seal the bolt in the breech before the gas spring releases its stored energy to launch the projectile. In another embodiment, the bolt is coupled with a magnet instead of a cam.

15 Claims, 11 Drawing Sheets

(56) References Cited

U.S. PATENT DOCUMENTS

| | | | | |
|---|---|---|---|---|
| 2009/0056693 | A1* | 3/2009 | Pedicini | F41B 11/64 124/73 |
| 2009/0235911 | A1* | 9/2009 | Klarborg | F41B 11/646 124/66 |
| 2011/0192387 | A1* | 8/2011 | Hu | F41B 11/646 124/80 |
| 2015/0377582 | A1* | 12/2015 | Kang | F41B 11/64 124/71 |
| 2017/0176130 | A1* | 6/2017 | Kang | F41B 7/08 |
| 2017/0176132 | A1* | 6/2017 | Kang | F41B 11/89 |
| 2017/0276451 | A1* | 9/2017 | Kang | F41B 7/006 |
| 2018/0045483 | A1* | 2/2018 | Iwasawa | F41B 11/646 |
| 2019/0093977 | A1* | 3/2019 | Kim | F41A 33/06 |
| 2020/0141672 | A1* | 5/2020 | Silva | F41B 11/71 |

* cited by examiner

PROJECTILE LAUNCHING APPARATUS

CROSS REFERENCE TO RELATED APPLICATIONS

The present application is a non-provisional application of and claims priority under 35 U.S.C. § 119 on U.S. Provisional Patent Application Ser. No. 62/890,465, filed on Aug. 22, 2019, the disclosure of which is incorporated by reference.

FIELD OF THE DISCLOSURE

The present disclosure relates generally to mechanical projectile launching apparatuses, and more particularly, to projectile launching apparatuses operated by gas compressed by electrical motor driven linear motion converters.

BACKGROUND OF DISCLOSURE

Developments have been seen in the field of projectile launching apparatuses, such as air rifles, pneumatic guns, pellet rifles, paintball guns and the like. Paintball guns have been around for many years and have seen numerous evolutionary changes over the years. The most common mechanisms for launching projectiles, such as pellets, BB bullets and paintballs use energy of a compressed gas or a spring. However, there are variety of mechanisms described in the prior art for launching these projectiles. Such mechanisms include use of a stored compressed gas in a form of carbon dioxide cylinders or other high pressure storage tanks, use of a powerful spring to push a piston which compresses air to push a projectile, use of a hand pump to pressurize the air for subsequent release, and use of a direct acting means such as a solenoid plunger or a centrifugal force to push the projectile out of a barrel. The above mentioned mechanisms generally suffer from a number of disadvantages as explained below.

The mechanism of using stored compressed gas, such as carbon dioxide, requires a storage means, such as a tank, a gas chamber, or a canister. The use of the storage means involves a cumbersome method of filling a gas in the storage means and transporting of the storage means based projectile launching apparatus. Additionally, the use of such storage means require additional equipment such as regulators, evaporation chambers, and other controls to reduce the pressure of the stored compressed gas for a safe launching of the projectiles. The requirement of such additional equipment increases the cost and the complexity of a projectile launching apparatus. In a typical projectile launching apparatus, which uses the storage means, velocity of the projectile varies significantly depending on the temperature of the storage means. For example, a pressure of the carbon dioxide gas depends upon the temperature of the canister, containing the carbon dioxide gas. Furthermore, the storage means stored with a large amount of compressed gas may cause potential safety hazard by a sudden release of compressed gas due to a fault in the storage means.

U.S. Pat. Nos. 6,516,791, 6,474,326, 5,727,538 and 6,532,949 describe various ways of porting and controlling of high pressure gas supply to improve the reliability of projectile launching apparatuses, specifically, guns. The control of the high pressure gas supply is achieved by differentiating air streams, such as an air stream which is delivered to a bolt to facilitate the chambering of the projectile in a barrel and an air stream which pushes the projectile out of the barrel. However, all the above listed US patents suffer from major inconvenience and potential safety hazard of storing a large volume of a highly compressed gas within the guns. Additionally, these guns combine an electronic control coupled with the propulsion method driving mechanism of stored compressed gas, which tend to increase the inherent complexity of the mechanism used in the gun, as well as, increase the cost and reliability issues.

The another mechanism which has been used for quite a few years in many different types of pellet, "BB bullets" or air guns has a basic principle of storing energy in a spring, which is subsequently released to rapidly compress gas, especially air present in the atmosphere. The highly compressed gas is generated by the spring acting on a piston to push the projectile out of the barrel at a high velocity. Problems with such mechanism include the need to "cock" the spring between successive shots and thereby limiting such guns to be a single shot device or a gun with a low rate of firing. Further, unwinding of the spring results in a double recoil effect. The first recoil is from the initial forward movement of the spring and the second recoil when the spring slams the piston into an end of a cylinder (i.e. forward recoil).

A typical gun including the spring requires a significant amount of maintenance and, if dry-fired (without projectile), the mechanism is easily damaged. Finally, the effort required for such "cocking" is often substantial and can be difficult for many individuals. References to these guns are found in U.S. Pat. Nos. 3,128,753, 3,212,490, 3,523,538, and 1,830,763. Additional variation on the above mechanism has been attempted through the years including using an electric motor to cock the spring that drives the piston. This variation is introduced in U.S. Pat. Nos. 4,899,717 and 5,129,383. While this variation solves the problem of cocking effort, the resulting air gun still suffers from a complicated mechanism, the double recoil effect and the maintenance issues associated with such a spring piston system. A further mechanism which uses a motor to wind the spring is described in U.S. Pat. Nos. 5,261,384 and 6,564,788, issued to Hu.

Hu's patents disclose a motor for compressing a spring, where the motor is connected to a piston. The spring is quickly released such that the spring drives the piston to compress the air, which pushes the projectile out the barrel. This implementation still suffers from similar limitations inherent in the spring piston systems. Hu describes the use of the motor to wind the spring in the above listed patents. Specifically, the spring must quickly compress the air against the projectile to force the projectile out of the barrel at a high velocity. This requires a strong spring to rapidly compress the air when the piston releases. Springs in such systems are highly stressed mechanical element which are prone to breakage and also increase the weight of the air gun. A further disadvantage of Hu's patents is that the spring is released from a rack pinion under full load causing tips of gear teeth to undergo severe tip loading. This causes high stress and wear on the mechanism especially on the gear teeth. This is a major complaint for those guns in the commercial market and is a major reliability issue with this mechanism.

A further disadvantage of this type of mechanism is that for launching a larger projectile or a projectile requiring a high velocity of launch, there occurs much increased wear and forward recoil, which is the result of the piston impacting the front end of the cylinder. In the dry fire, the mechanism can be damaged as the piston slams against the face of the cylinder. Hu describes use of a breech shutoff that is common in virtually all toy guns since the air must be directed down the barrel and the flow into a projectile inlet port must be minimized. Further, Hu specifically does not incorporate an air compression valve in the above listed patents, which is a restrictive valve against which the piston compresses the air for subsequent releases. Thus, forward recoil, high wear and low power are drawbacks in this type of mechanism. A similar reference can be seen in U.S. Pat. No. 1,447,458, which shows a spring winding and then delivery to a piston to compress air and propel a projectile. In this case, the device is for non-portable operation.

The additional mechanism, which uses hand pumps to pressurize the air, is often used in low end devices. The use of such mechanism suffers from a need to pump the air between 2 to 10 times to build up enough air supply for a sufficient projectile launch velocity. This again limits the gun, such as the paintball gun, to slow rates of fire. Additionally, because of the delay between as to when the air is compressed and when the compressed air is released to the projectile causes variations in the projectile launch velocity.

Further, U.S. Pat. Nos. 2,568,432 and 2,834,332 describe a mechanism to use a solenoid to directly move the piston, which compresses the air and launches the projectile out of the barrel. While this mechanism solves the obvious problem of manually pumping a chamber up in order to fire a gun, devices incorporating this mechanism suffer from the inability to store sufficient energy in the compressed air. The solenoid here is an inefficient device and only capable of converting a very limited amount of energy in the compressed air due to its operation. Furthermore, since the compressed air is applied directly to the projectile in this mechanism similar to the spring piston mechanism, the projectile begins to move as the air starts being compressed. This limits the ability of the solenoid to store energy in the compressed air to a very short time period and therefore these devices cater to low energy guns.

In order to improve the design, the piston must actuate in an extremely fast time frame in order to prevent significant projectile movement during a compression stroke. This results in a very suitable piston mass similar to the spring piston designs which results in the undesirable double recoil effect as the piston mass must come to a halt. Additionally, when this mechanism suffers from dry-fire, the air is communicated to the atmosphere through the barrel, causing damage to the mechanism. Another variant of this approach is disclosed in U.S. Pat. No. 1,375,653, which uses an internal combustion engine instead of the solenoid to act against the piston. Although this solves the issue of sufficient power, the use of the internal combustion engine is no longer considered as an air rifle as it becomes a combustion driven gun. Moreover, the use the internal combustion engine suffers from the aforementioned disadvantages including complexity and difficulty in controlling the firing sequence.

U.S. Pat. Nos. 4,137,893 and 2,398,813 issued to Swisher disclose an air gun using an air compressor coupled to a storage tank, which is then coupled to the air gun. Although this solves the issue of double recoil effect, the arrangement still is not suitable to a portable system due to inefficiencies of compressing the air and the requirement of a large tank volume. This type of air gun is quite similar to an existing paintball gun in which the air is supplied via the air tank and not compressed on demand. Using air in this fashion is inefficient and is not suitable for a portable operation since much of compressed air energy is lost to the environment through the air tank via cooling. Forty percent or more (depending on the compression ratio) of the compressed air energy is stored as heat and is lost to do work when the air is allowed to cool. Furthermore, additional complexity and expenses are required to regulate the air pressure from the air tank so that the projectile launch velocity is controlled. A variation of the above described mechanism is use of a direct air compressor as described in U.S. Pat. No. 1,743,576. Again, due to the large volume of air between compression means and the projectile, much of the compressed air energy especially, a heat of compression, is lost leading to inefficient operation. Additionally, the U.S. Pat. No. 1,743,576 teaches a continuously operating device which suffers from a significant lock time (time between a trigger pull in order to initiate the launch and the projectile leaving the barrel) as well as the inability to run in a semiautomatic or single shot mode. Further, disadvantages of this mechanism include the pulsating characteristics of the compressed air, which are caused by the release and reseating of a check valve during normal operation.

U.S. Pat. Nos. 1,343,127 and 2,550,887 disclose a mechanism to use a direct mechanical action on the projectile. Limitations of this approach include difficulty in achieving high projectile velocity since the transfer of energy must be done extreme rapidly between an impacting hammer and the projectile. Further limitations of this mechanism include a need of absorbing a significant impact as a solenoid plunger must stop and return for the next projectile. This causes double-recoil or forward recoil. Since the solenoid plunger represents a significant fraction of the moving mass (i.e. solenoid plunger often exceeds the projectile weight), this type of apparatus is very inefficient and limited to low velocity, such as required in low energy air guns for the purpose of toys and the like. Variations of this method include those disclosed in U.S. Pat. No. 4,694,815 in which the impact hammer is driven by a spring that contacts the projectile. The spring is "cocked" via an electric motor, but again, this does not overcome the prior mentioned limitations.

All of the currently available projectile launching apparatuses suffer from one or more of the following disadvantages. These disadvantages include, but are limited to, a manual operation by cocking a spring or pumping up an air chamber, difficulty to selectively perform single fire, semi-automatic mechanism, burst or automatic modes in these projectile launching apparatuses. Further, inconvenience, safety and consistency issues associated with refilling, transport and the use of high-pressure gas or carbon dioxide cylinders being the safety hazard. Furthermore, disadvantages include non-portability and low efficiency of these projectile launching apparatuses, which are associated with compressed air supplied from a typical air compressor. The forward recoil effects, high wear, and dry fire damage associated with a spring piston such as an electrically actuated spring piston designs. Complicated mechanisms associated with electrically winding and releasing of the spring piston design result in expensive mechanism having reliability issues. Inefficient use and/or coupling of the compressed air to the projectile also restrict their capability to launch the projectile with high velocity.

Accordingly, there exists a need for a projectile launching apparatus which includes all the advantages of the prior art and overcomes the drawbacks inherent therein.

SUMMARY OF THE DISCLOSURE

In view of foregoing disadvantage inherent in the prior art, the general purpose of the present disclosure is to provide a projectile launching apparatus, to include all the advantages of the prior art, and overcome the drawbacks inherent therein.

In light of the above objects, in one aspect of the present disclosure, a projectile launching apparatus is provided. The projectile launching apparatus includes a power source, a motor, a control circuit, a cylinder, a piston, a gear box, a barrel cam, a gas spring and a breech assembly. The motor is electrically connected to the power source. The control circuit is configured to control a power supply to the motor from the power source. The barrel cam is driven by the motor. The barrel cam is operatively coupled to a piston and is configured to cause the piston to reciprocally move within the cylinder, energizing the gas spring. When the gas spring is fully energized, the barrel cam releases the piston, generating pressure inside of the cylinder. The piston reciprocally moves within the cylinder to define a gas chamber within the cylinder to accommodate gas therein.

The breech assembly includes a barrel, at least one projectile inlet port and a bolt. The projectile inlet port is configured on the barrel and is adapted to receive a projectile into the barrel. The bolt includes a front portion and a rear portion. The bolt is operatively coupled to an additional barrel cam and is capable of reciprocating between a first position and a second position. In the first position the bolt is configured to be partially received within the barrel such that the front portion of the bolt shuts off the projectile inlet port and in the second position the bolt is configured to enable the projectile to enter the barrel from the projectile inlet port. The gas received within the gas chamber is compressed by the piston in a single rotation of the piston barrel cam arrangement. The compressed gas is released from the gas chamber into the barrel that causes the compressed gas to expand in the barrel and accordingly, the projectile is launched from the barrel with the single rotation of the barrel cam arrangement.

In an embodiment, the apparatus comprises a velocity control means for adjusting the velocity of the projectile that is launched from the apparatus. In an embodiment, the velocity control means comprises a bleed valve that is operatively coupled to the gas chamber. The bleed valve may allow gas to release from the gas chamber, thereby reducing the pressure within the gas chamber and accordingly adjusting the velocity of a projectile to be launched by the apparatus.

In another aspect, the present disclosure provides a projectile launching apparatus, which includes a power source, a motor, a control circuit, a cylinder, a piston, a gearbox, a barrel cam and a magnetically actuated bolt arrangement. The motor is electrically connected to the power source. The control circuit is configured to control a power supply to the motor from the power source. The barrel cam and piston assembly is driven by the motor. At least one magnet is operatively coupled to a piston and is configured to cause the bolt to reciprocally move within the breech to enable the projectile to enter the barrel from the projectile inlet port. As the piston reciprocates in the cylinder it pulls the bolt open until it reaches the bolt's end of stroke. At this point the magnets release and the bolt spring pushes the bolt forward to chamber the projectile and seal the barrel.

The breech assembly includes a barrel, a projectile inlet port and a bolt. The projectile inlet port is configured on the barrel and adapted to receive a projectile. The bolt includes a front portion and a rear portion. The bolt is operatively coupled to the linear motion converter and is capable of reciprocating between a first position and a second position. In the first position the bolt is configured to be partially received within the barrel such that the front portion of the bolt shuts off the projectile inlet port and in the second position the bolt is configured to enable the projectile to enter the barrel from the projectile inlet port. A compression valve arrangement is operatively disposed between the cylinder and the barrel.

These together with other aspects of the present disclosure, along with the various features of novelty that characterize the present disclosure, are pointed out with particularity in the claims annexed hereto and form a part of this disclosure. For a better understanding of the present disclosure, its operating advantages, and the specific objects attained by its uses, reference should be made to the accompanying drawings and descriptive matter in which there are illustrated exemplary embodiments of the present disclosure.

BRIEF DESCRIPTION OF THE DRAWING FIGURES

The advantages and features of the present disclosure will become better understood with reference to the following detailed description and claims taken in conjunction with the accompanying drawings, wherein like elements are identified with like symbols, and in which:

Figure 14:
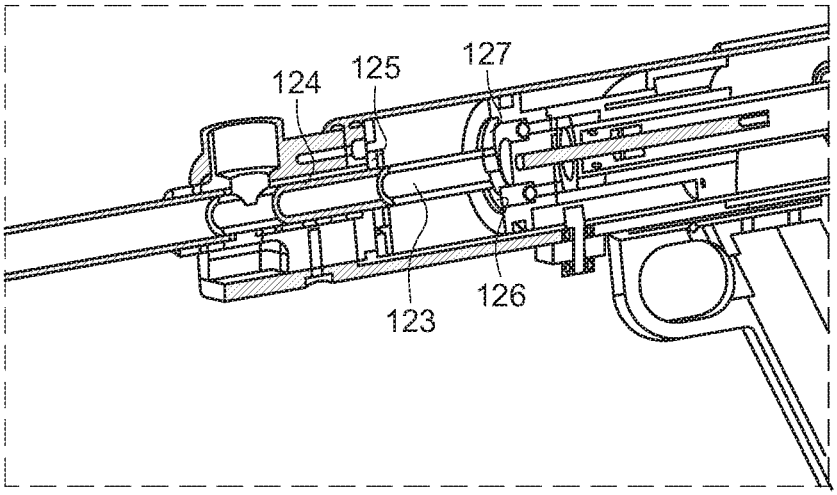
Figure 15:
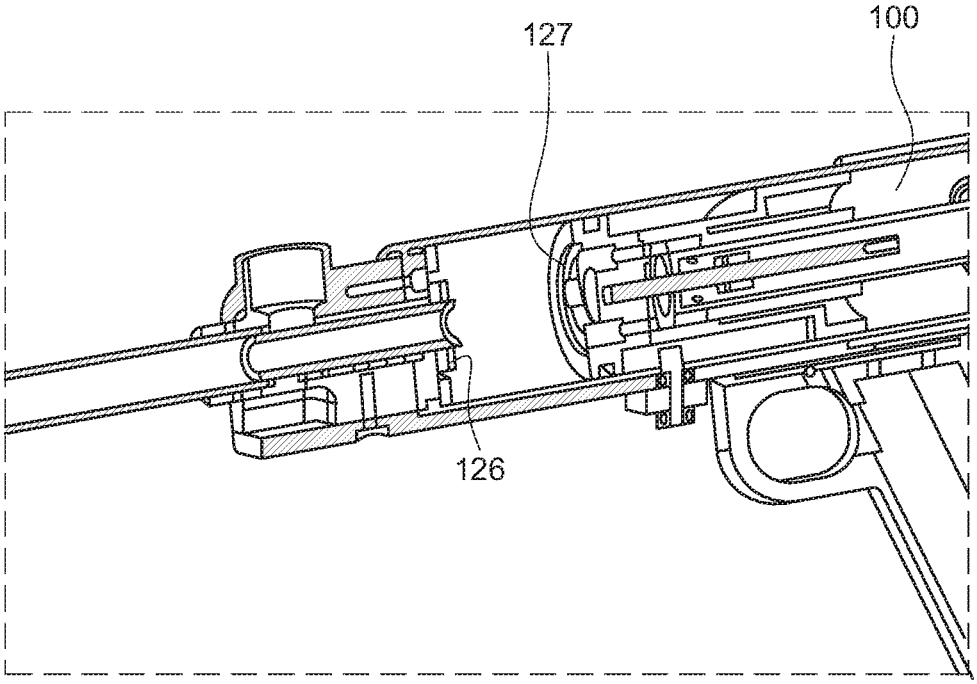

FIGS. 14; illustrates a partial isometric view of the operational cycle showing the magnetic bolt retracting as the piston retracts and energizes the gas spring, according to an exemplary embodiment of the present disclosure; and FIG. 15 illustrates a partial isometric view of the operational cycle after the magnets release the bolt and while the gas spring is fully energized, according to an exemplary embodiment of the present disclosure;

Like reference numerals refer to like parts throughout the description of several views of the drawings.

DETAILED DESCRIPTION OF THE DISCLOSURE

The exemplary embodiments described herein detail for illustrative purposes are subject to many variations in structure and design. It should be emphasized, however, that the present disclosure is not limited to a particular projectile launching apparatus, as shown and described. It is understood that various omissions and substitutions of equivalents are contemplated as circumstances may suggest or render expedient, but these are intended to cover the application or implementation without departing from the spirit or scope of the claims of the present disclosure.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present disclosure provides a projectile launching apparatus for launching a projectile, such as a pellet, a BB bullet, an arrow, a dart and a paintball. The projectile launching apparatus may be an arrangement of a linear motion converter driven by a motor, a piston coupled to the linear motion converter and reciprocally movable within a cylinder, a gas spring and a breech assembly. The piston, which is capable of having reciprocal movement caused by the linear motion converter, compresses a gas within the cylinder, which compressed gas is communicated to a barrel of the breech assembly. The compressed gas expands in the barrel of the breech assembly for launching the projectile, which projectile is chambered in the barrel, with a high velocity (or an adjusted velocity as elsewhere described herein).

Figure 1:
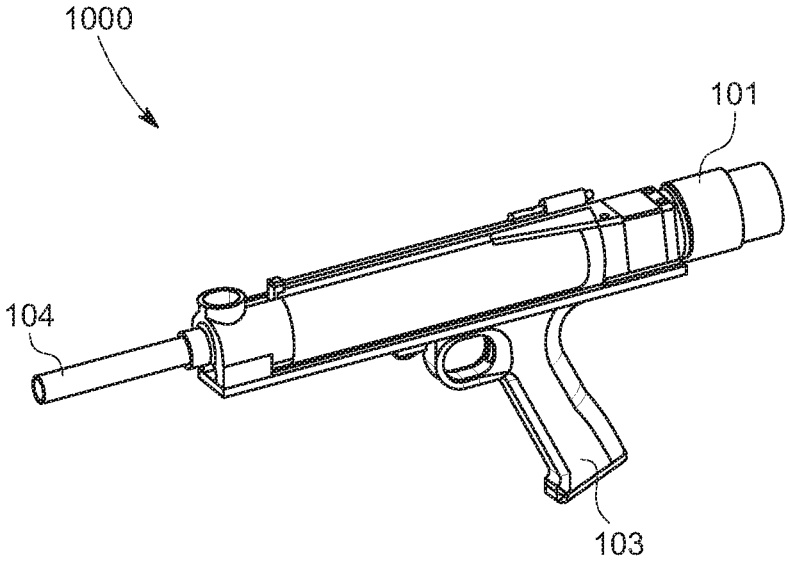
FIG. 1 illustrates an isometric view of a projectile launching apparatus, according to an exemplary embodiment of the present disclosure.
Figure 2:
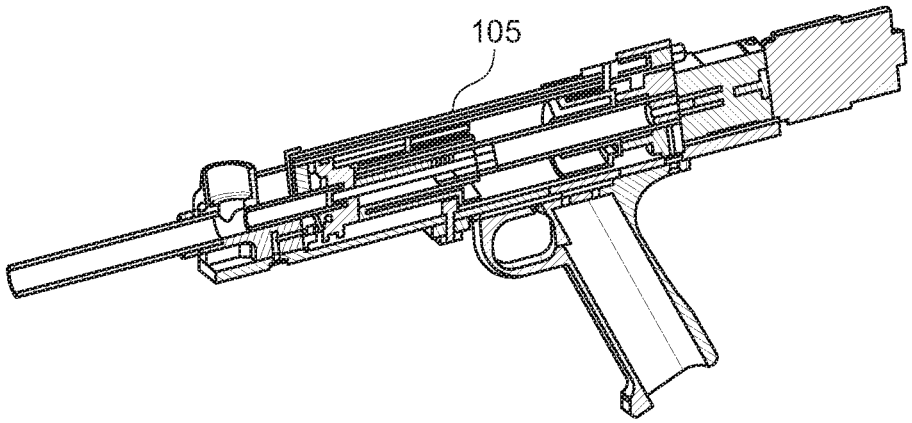
FIG. 2 illustrates a longitudinal cross-sectional view of a projectile launching apparatus, according to an exemplary embodiment of the present disclosure.

FIG. 1 is an isometric view of a projectile launching apparatus 1000, according to an exemplary embodiment of the present disclosure. The projectile launching apparatus 1000 includes a start switch, a power source, a motor 101, a control circuit, a gear reduction mechanism 102, a cylinder 105, a linear motion converter 110 (herein the linear motion converter 110 is a barrel cam, so hereinafter the 'linear motion converter 110' is interchangeably referred to as the 'barrel cam 110'), a gas spring 100, a handle 103, and a breech assembly 128. The projectile launching apparatus 1000 is capable of launching a projectile from a barrel 104 of the breech assembly 128 with the help of a gas compressed within the cylinder 105 due to a reciprocal movement of a piston 109 that is coupled to the linear motion converter 110. FIG. 2 shows a cross-sectional view of an exemplary apparatus 1000.

The operation cycle of the projectile launching apparatus 1000 may start by pressing ON on the start switch of the apparatus. The power source is configured to supply power to the motor 101 through the control circuit. Specifically, the motor 101 is electrically connected to the power source through the control circuit. The control circuit may be any electronic-based apparatus that is capable of connecting power to the motor 101 for the purpose of initiating an operation cycle of the projectile launching apparatus 1000. The control circuit is further capable of disconnecting the power to the motor 101 after the operation cycle of the projectile launching device 1000 is completed. Herein, the operation cycle of the projectile launching apparatus 1000 denotes an operation involved in launching the projectile from the barrel 104 of the projectile launching apparatus 1000 upon once pressing the start switch ON. The motor 101 generates a rotational movement, when the motor 101 is powered ON and the rotational movement of the motor 101 is transferred to a movement of the linear motion converter 110 through the gear reduction mechanism 102.

In the exemplary embodiment of the present disclosure as shown in FIG. 1, the gear reduction mechanism 102 includes a plurality of gears, such as planet gears and ring gears. The gear reduction mechanism 102 is configured to transfer the rotational movement of the motor 101 into the movement of the linear motion converter 110. Herein, for the purpose of exemplary representation, the gears are represented as planetary gears in FIG. 1. However, it will be apparent to a person skilled in the art that the gears may include other type of gears, such as a helical gear, a bevel gear and a face gear. Further, the gear reduction mechanism 102 may include a plurality of such gears or a combination of such gears, which are capable of transferring the rotational movement of the motor 101 to the movement of the linear motion converter 110.

Although herein the linear motion converter 110 is represented as a barrel cam (and hereinafter referred to as "barrel cam 110"), it will be apparent to a person skilled in art that the linear motion converter 110 may be any suitable mechanism that converts the rotational movement of the motor 101 into a linear reciprocal movement of any element. For example, the linear motion converter may include other arrangements such as a rack and pinion arrangement, a lead screw arrangement and a crankshaft and connecting rod arrangement.

Figure 3:
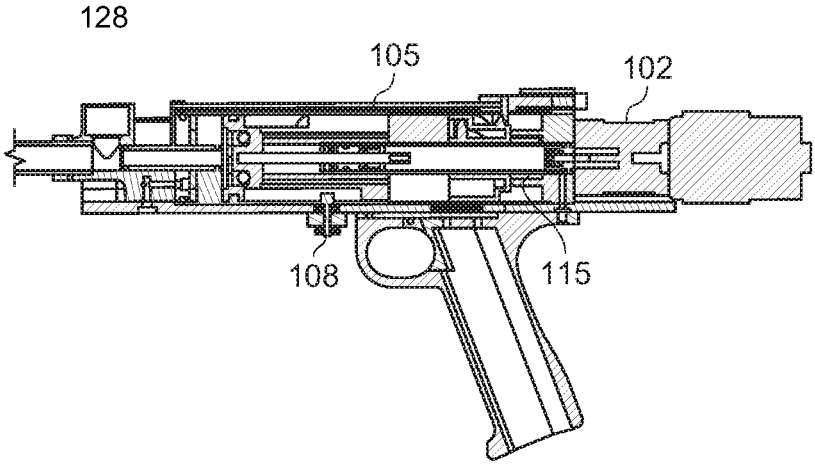
FIG. 3 illustrates a partial section view of a projectile launching apparatus, according to an exemplary embodiment of the present disclosure.
Figure 4:
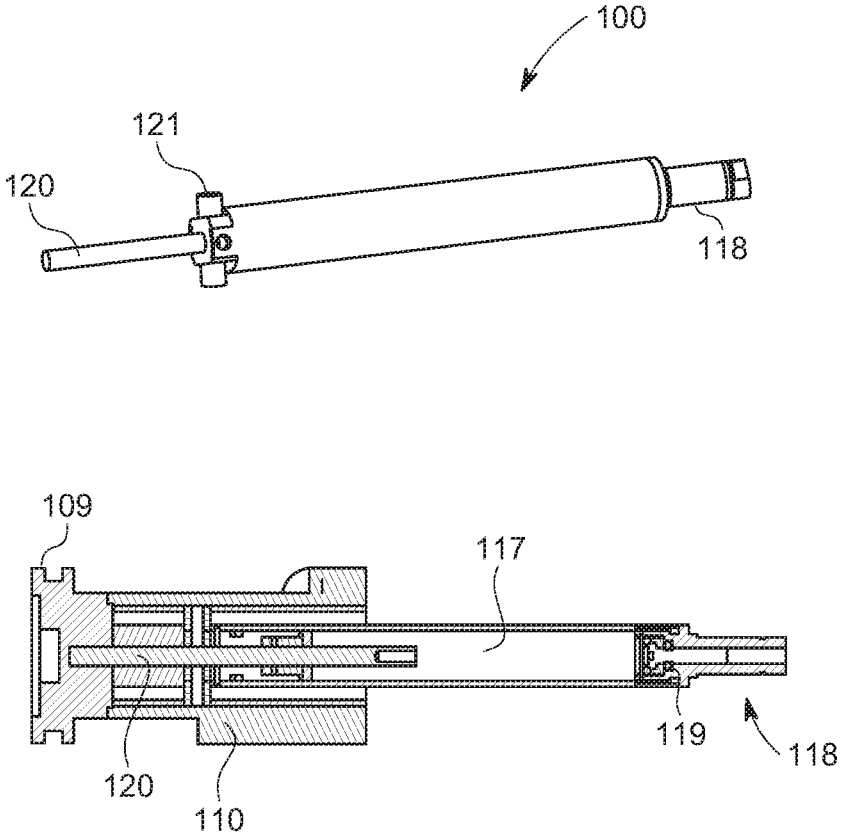
FIG. 4 illustrates an isometric and a cross-sectional view of the gas spring, barrel cam and piston configuration, according to an exemplary embodiment of the present disclosure.
Figure 5:
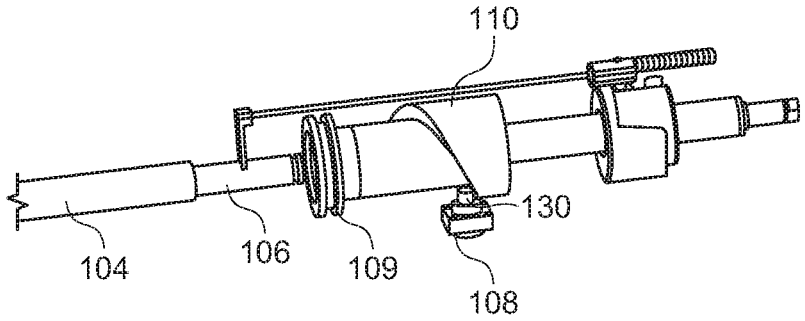
FIG. 5 illustrates a partial isometric view of the operational cycle after release of the piston and firing a projectile, according to an exemplary embodiment of the present disclosure.

The barrel cam arrangement includes a barrel cam 110 (shown in FIG. 4 and FIG. 5, for example) and a fixed follower assembly 108 (shown in FIG. 3 and FIG. 5, for example). The follower assembly 108 includes a follower 130 (shown in FIG. 5, for example) and follower bearings 129 (shown in FIG. 9, for example). In an embodiment, the apparatus further comprises a stationary cam follower, which cam follower may contact the barrel cam to force linear movement as the barrel cam rotates, thereby energizing the gas spring.

The barrel cam 110 is further coupled to the piston 109 (shown in FIG. 5 and FIG. 9, for example), which is partially disposed within the cylinder 105. The rotation of the barrel cam 110 enables the barrel cam 110 and the piston 109 to move reciprocally within the cylinder 105 as the fixed follower assembly 108 rolls on the barrel cam 110.

Figure 6:
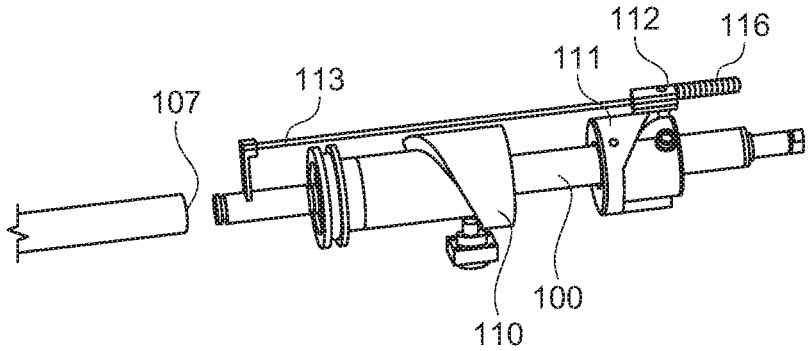
FIG. 6 illustrates a partial isometric view of the operational cycle showing the bolt retracting to allow a projectile to enter the breech, according to an exemplary embodiment of the present disclosure.

The barrel cam 110 and the piston 109 are further coupled to the gas spring 100, as shown in FIG. 6, for example. The gas spring 100 is energized as the barrel cam 110 and the piston 109 move reciprocally within the cylinder 105. The gas spring 100 is comprised of a gas spring cylinder 117, a gas spring end cap and fill port 118, a gas spring seal 119 and a gas spring piston 120 (shown in FIG. 4, for example). The gas spring piston 120 is operably coupled to the piston 109. The gas spring cylinder 117 is capable of accommodating gas therein. The gas spring cylinder 117 is pressurized within a range of 100 and 5000 psi. In an embodiment, the gas spring further comprises a rod seal disposed upon the piston of the gas spring.

Referring now to FIGS. 3, 5, 6, 7 and 8, a breech assembly 128 is comprised of a breech 107 and a bolt 106. In order to allow a projectile to enter the breech assembly, the bolt 106 must move reciprocally within the breech 107. The reciprocal movement of the bolt 106 is accomplished by a bolt driving mechanism. In an embodiment, the mechanism comprises coupling the bolt 106 to a bolt rod 113. In an embodiment, the mechanism comprises further the bolt rod 113 being operably coupled to the bolt follower assembly 112. In an embodiment, the bolt follower assembly 112 may be biased forward by a bolt assembly spring 116. The bolt 106, bolt rod 113 and bolt follower assembly 112 are all operably coupled and move together. In an embodiment, the bolt follower assembly 112 is in contact with a second linear motion convertor. In an exemplary embodiment the second linear motion convertor comprises a bolt barrel cam 111. The bolt barrel cam 111, the gas spring 100, the barrel cam 110 and the piston 109 are capable of all rotating together. As the bolt barrel cam rotates, it moves the bolt follower assembly 112, bolt rod 113 and bolt 106 reciprocally to allow a projectile to enter the breech 107 and then to seal the bolt in the breech before the gas spring 100 releases its stored energy to launch the projectile.

Referring to FIG. 4, an exemplary gas spring 100 is depicted. The gas spring piston 120 is coupled to the piston 109. FIG. 4 also depicts the coupling of the piston 109 to the barrel cam 110. The gas spring 100 may also incorporate drive rollers 121. The drive rollers 121 may engage with the barrel cam 110 to allow both rotation and linear reciprocation of the barrel cam 110. For example, the rollers 121 may transmit the torque of the motor to the barrel cam, thus allowing the barrel cam to rotate and to translate linearly to energize the gas spring. As the gas spring 100 rotates, the barrel cam 110 makes contact with the follower assembly 108 (shown in FIGS. 5, 6, 7 and 8, for example), forcing the barrel cam 110 to slide linearly in the cylinder 105. This motion energizes the gas spring 100 until the barrel cam 110 releases from the follower 130, thereby allowing the piston 109 and barrel cam 110 to move away from the gas spring 100 to compress air in front of the piston 109. This compressed air moves through the bolt 106 and the barrel 104 to launch the projectile.

Figure 7:
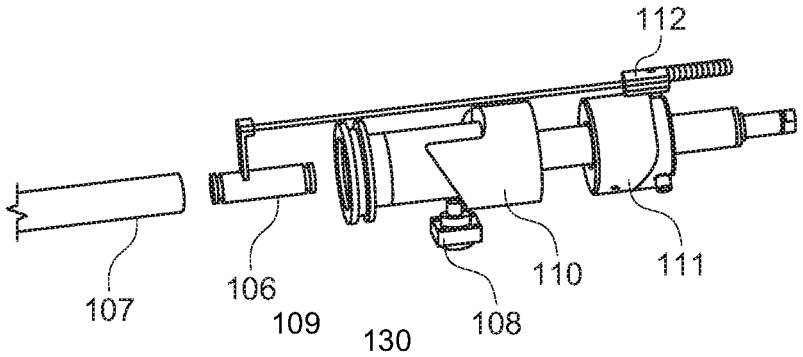
FIG. 7 illustrates a partial isometric view of the operational cycle showing the bolt retracted while the barrel cam is energizing the gas spring, according to an exemplary embodiment of the present disclosure.
Figure 8:
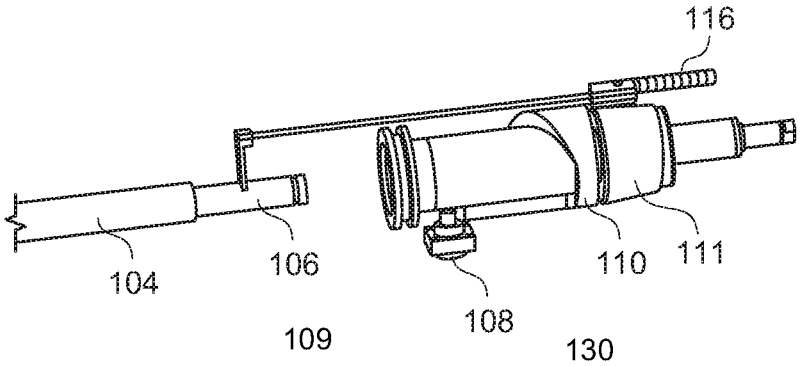
FIG. 8 illustrates a partial isometric view of the operational cycle after a second barrel cam releases the bolt and while the gas spring is fully energized, according to an exemplary embodiment of the present disclosure.
Figure 9:
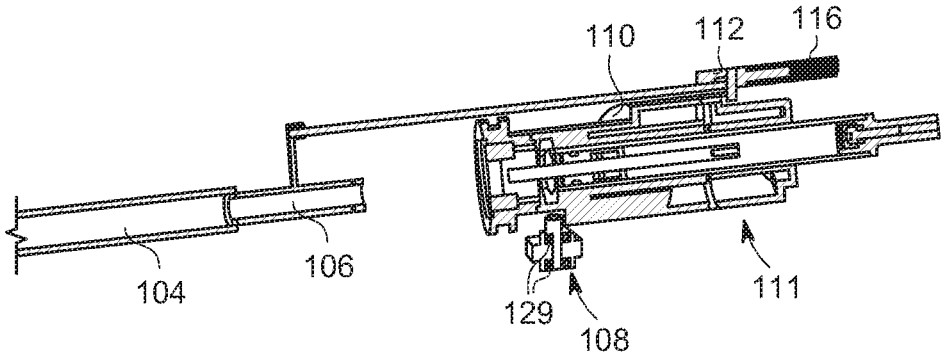
FIG. 9 illustrates a cross sectional view of FIG. 8, according to an exemplary embodiment of the present disclosure.

In the preferred embodiment of the disclosure, an exemplary full cycle is depicted in FIGS. 5, 6, 7 and 8. FIG. 5 depicts the operational elements of the disclosure immediately after a projectile has been launched. The gas spring 100 is not energized and the bolt 106 is sealed in the barrel 104. As the gas spring 100 starts to rotate in FIG. 6 via the gear box 102 and the motor 101, the follower 130 rolls on the barrel cam 110 to start to energize the gas spring 100. The bolt barrel cam 111 also rotates and moves the bolt follower assembly 112 reciprocally. This energizes the bolt assembly spring 116 and moves the bolt 106 linearly to open the breech 107 and allow a projectile to enter. FIG. 7 continues the cycle as the elements rotate. In FIG. 7, the bolt is fully open and is maintained in the open position long enough for a projectile to enter the breech 107. In this embodiment, the bolt 106 is maintained in its fully open position for at least 45 degrees, and preferably up to 300 degrees of rotation. (This section of the cam that so maintains the bolt 106 is referred to herein as a dwell). In an embodiment, the preferred dwell is greater than 180 degrees. Each degree of rotation energizes the gas spring 100 more as the barrel cam 110 moves linearly. In FIG. 8, the dwell of the bolt barrel cam 111 is completed as the bolt follower assembly disengages from the bolt barrel cam 111, allowing the bolt assembly spring 116 to move the bolt 106 forward sealing the projectile into the barrel 104 where it is ready for launch. FIG. 8 depicts the maximum energized state of the gas spring 100, where the follower 130 is about to disengage the barrel cam 110. This energized state is also shown in FIG. 9. The next few degrees of rotation may release the barrel cam 110, allowing it to move reciprocally towards the breech 107, thereby compressing the air in front of the piston 109 to launch a projectile.

Figure 10:
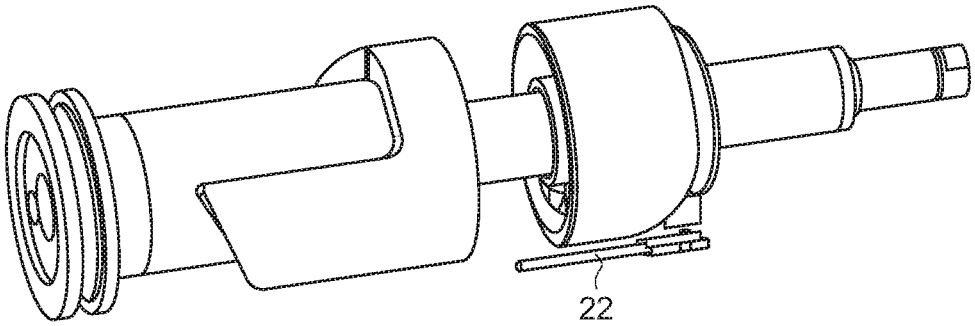
FIG. 10 illustrates the location of the sensor which determines the location of the rotation, according to an exemplary embodiment of the present disclosure.

The operational cycle can be stopped at any point during the sequence described above. However, the preferred stopping and starting point of the cycle is depicted in FIG. 7. It is preferred because the bolt 106 is in the open position between cycles. It is additionally preferred because when the cycle is resumed a projectile can be launched with only a few degrees of rotation after starting the cycle. This creates an elapsed time that is imperceptible to the user. That is, the user interprets the firing of the projectile as immediate. The time to launch the projectile from cycle start is preferably less than 120 msec. and more preferably less than 50 msec. Stopping of the cycle may be accomplished by using a sensor 22 as shown in FIG. 10. In an embodiment, the sensor determines a pre-determined position in the cycle and communicates to the control circuit to remove power from the motor, stopping the cycle. When the cycle stops (as seen in FIG. 7), the barrel cam 111 stops while in a position where it is engaged with the follower 130. This engagement creates a rotational force on the barrel cam 111 that wants to "back drive" the rotation of the cam. To prevent this, a one-way clutch 115, or a flat on the barrel cam 111 are used to retain its position. The one-way clutch 115 can be positioned anywhere in the rotational system including at the motor, at the gear box or the gas spring 100. In the preferred embodiment it is positioned on the gas spring 100 as depicted in FIG. 3. The one-way clutch 115 may be one of a roller clutch, a Sprague clutch, a ratchet and pawl or a detent or the like.

In another embodiment of the present disclosure, the bolt is coupled with a magnet instead of a cam. This embodiment is depicted in FIGS. 11-15. In an embodiment, the apparatus comprises a breech assembly. The breech assembly may comprise a barrel, a projectile inlet port configured on the barrel, the projectile inlet port adapted to receive a projectile. In an embodiment, and as will be described in more detail herein, the bolt may comprise a magnet coupled to the piston to move the bolt to a first position and a, bolt spring to move the bolt to a second position once the bolt is released by the magnet.

Figure 11:
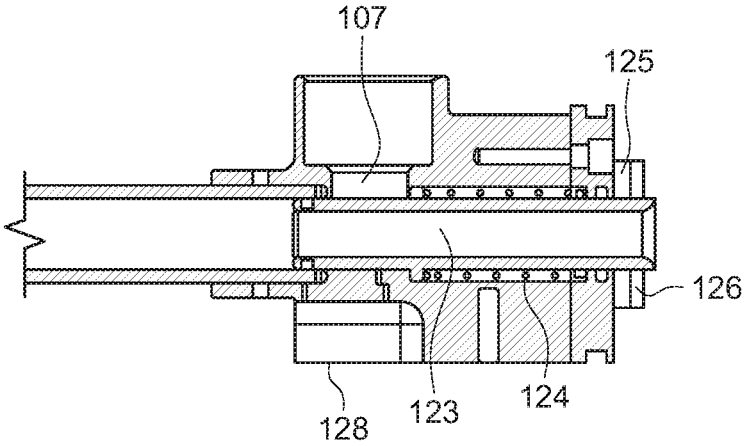
FIG. 11 illustrates a longitudinal cross-sectional view of a a breech assembly configured for a magnetic bolt arrangement, according to an exemplary embodiment of the present disclosure.
Figure 12:
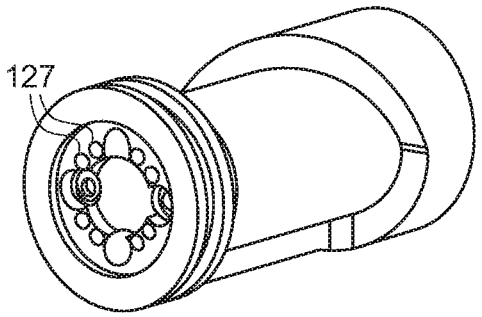
FIG. 12 illustrates an isometric view of the barrel cam and piston with magnets coupled to the piston, according to an exemplary embodiment of the present disclosure.
Figure 13:
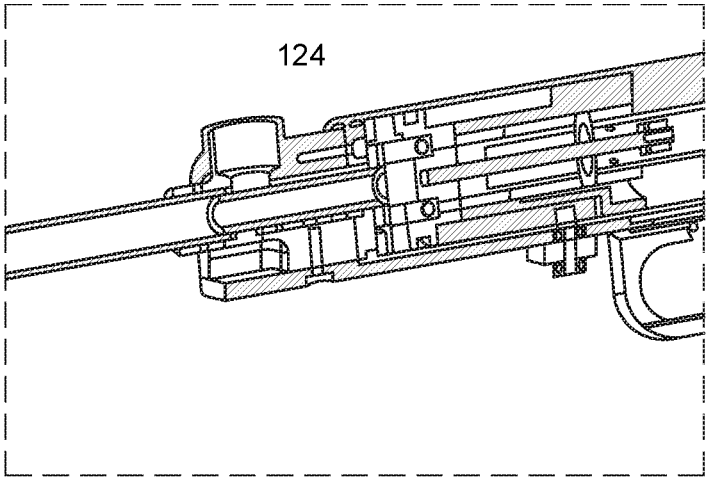
FIG. 13 illustrates a partial isometric view of the operational cycle after release of the piston and firing a projectile utilizing the magnetic bolt arrangement, according to an exemplary embodiment of the present disclosure.

FIG. 11 depicts a magnet bolt 123 located inside of the breech 107. The magnet bolt 123 is biased forward (i.e. toward the barrel) by a magnet bolt spring 124. At the distal end of the magnet bolt 123 is a magnet bolt plate 126. Between the magnet bolt plate 126 and breech 107 is a bolt plate bumper 125. In this embodiment, magnets 127 are operably coupled to the piston 109. When the piston is in its forward most position (as depicted in FIG. 13), the magnets 127 attract to the magnet bolt plate 126 and retain them together with sufficient force to energize the magnet bolt spring 124 as the magnet bolt 123 moves with the piston 109. As the cycle continues with the piston 109 moving to energize the gas spring 100, the magnet bolt 123 moves with it (as seen in FIG. 14). This moves the magnet bolt 123 in the breech 107, energizing the magnet bolt spring 124 and allowing a projectile to enter the breech 107. As the piston 109 continues to energize the gas spring 100, the magnets 127 release from the magnet bolt plate 126 as shown in FIG. 15. Once the release occurs, the magnet bolt spring 124 moves the magnet bolt 123, chambering a projectile and sealing into the barrel 104. At this point the rest of the cycle can be completed to launch the projectile.

The foregoing descriptions of specific embodiments of the present disclosure have been presented for purposes of illustration and description. They are not intended to be exhaustive or to limit the disclosure to the precise forms disclosed, and obviously many modifications and variations are possible in light of the above teaching. The embodiments were chosen and described in order to best explain the principles of the disclosure and its practical application, and to thereby enable others skilled in the art to best utilize the disclosure and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present disclosure.

What is claimed is:

1. A projectile launching apparatus, comprising:
a power source;
a motor electrically connected to the power source;
a control circuit configured to control a power supply to the motor from the power source;
a cylinder comprising a piston reciprocally movable within the cylinder to define a gas chamber within the cylinder, the gas chamber capable of accommodating gas therein;
a barrel cam arrangement driven by the motor, the barrel cam operatively coupled to the piston and configured to cause the piston to reciprocally move within the cylinder for compressing the gas within the gas chamber;
a gas spring, the gas spring coupled to the piston and barrel cam such that when the barrel cam and piston are caused to move reciprocally the gas spring is energized; wherein the gas spring further comprises rollers that transmit the torque of the motor to the barrel cam allowing the barrel cam to rotate and to translate linearly to energize the gas spring;
a breech assembly comprising
a barrel,
a projectile inlet port configured on the barrel, the projectile inlet port adapted to permit a projectile to be received within the barrel, and
a bolt;
wherein the gas received within the gas chamber is compressed by the piston due to rotation of the barrel cam in a manner such that the compressed gas is released from the gas chamber into the barrel, causing the compressed gas to expand in the barrel thereby causing the projectile to be launched from the barrel.

2. The projectile launching apparatus of claim 1 further comprising a gear reduction mechanism, the gear reduction mechanism capable of transferring a rotational movement of the motor to the barrel cam arrangement.

3. The projectile launching apparatus of claim 1 further comprising a bolt driving mechanism coupled to the bolt for causing the bolt to move between the first position and the second position.

4. The projectile launching apparatus of claim 3, wherein the bolt driving mechanism comprises
a spring configured to move the bolt to the first position; and
a second cam operatively coupled to barrel cam arrangement to move the bolt to the second position.

5. The projectile launching apparatus of claim 1, further comprising at least one sensor configured to enable the control circuit to determine at least one position of the piston and or cam during an operational cycle of the apparatus.

6. The projectile launching apparatus of claim 1, further comprising a velocity control means coupled to the gas chamber wherein the velocity control means can be adjusted to allow gas to be released from the gas chamber, thereby adjusting the velocity of the projectile.

7. The projectile launching apparatus of claim 1, further comprising a stationary cam follower, whereby the cam follower contacts the barrel cam to force linear movement of the barrel cam as the barrel cam rotates, thereby energizing the gas spring.

8. The projectile launching apparatus of claim 1, further comprising a one-way clutch, whereby the one-way clutch allows rotation of the barrel cam arrangement in only one direction.

9. A projectile launching apparatus comprising:
a power source;
a motor electrically connected to the power source;
a cylinder comprising a piston reciprocally movable within the cylinder, the piston defining a gas chamber within the cylinder;
a gas spring;
a linear motion converter driven by the motor, the linear motion converter operatively coupled to the piston and configured to cause the piston to reciprocally move within the cylinder for compressing the gas within the gas chamber; wherein the gas spring further comprises rollers that transmit the torque of the motor to the linear motion converter allowing the linear motion converter to rotate and to translate linearly to energize the gas spring;
a breech assembly comprising
a barrel;
a projectile inlet port configured on the barrel, the projectile inlet port adapted to receive a projectile, and
a bolt comprising a front portion and a rear portion;
wherein the gas received within the gas chamber is compressed by the energized gas spring; and
wherein the compressed gas expanding in the barrel causes the projectile to be launched from the barrel.

10. The projectile launching apparatus of claim 9, wherein the linear motion converter is one of a barrel cam, slider crank arrangement, a rack and pinion arrangement, a lead screw arrangement, and a crankshaft and connecting rod arrangement.

11. The projectile launching apparatus of claim 9, further comprising a gear reduction mechanism, the gear reduction mechanism capable of transferring a rotational movement of the motor to the linear motion converter.

12. The projectile launching apparatus of claim 9, further comprising a bolt driving mechanism coupled to the bolt for causing the bolt to move between the first position and the second position.

13. The projectile launching apparatus of claim 12, wherein the bolt driving mechanism comprises
a spring configured to move the bolt to the first position; and
a bolt cam operatively coupled to the linear motion converter to move the bolt to the second position.

14. The projectile launching apparatus of claim 9, further comprising at least one sensor configured to enable the control circuit to determine at least one of the position of the piston within the cylinder during a stroke of the linear motion converter and a pre-determined position in the operational cycle of the apparatus.

15. The projectile launching apparatus of claim 9, the gas spring of said apparatus further comprising a rod seal.

* * * * *